US010895085B2

(12) United States Patent
Zolar

(10) Patent No.: US 10,895,085 B2
(45) Date of Patent: Jan. 19, 2021

(54) SYSTEM FOR ADJUSTING SURFACE LEVEL

(71) Applicant: Yoash Zolar, Tel-Aviv (IL)

(72) Inventor: Yoash Zolar, Tel-Aviv (IL)

( * ) Notice: Subject to any disclaimer, the term of this patent is extended or adjusted under 35 U.S.C. 154(b) by 766 days.

(21) Appl. No.: 14/061,794

(22) Filed: Oct. 24, 2013

(65) Prior Publication Data

US 2014/0208500 A1 Jul. 31, 2014

Related U.S. Application Data

(60) Provisional application No. 61/717,646, filed on Oct. 24, 2012.

(51) Int. Cl.
*E04H 4/06* (2006.01)

(52) U.S. Cl.
CPC ..... *E04H 4/065* (2013.01)

(58) Field of Classification Search
CPC .... E04G 1/15; E04G 1/18; E04G 1/34; E04H 3/26; E04H 3/28; E04H 3/126; E04H 3/165; E04H 4/065; E04H 2003/142; A47C 1/126
See application file for complete search history.

(56) References Cited

U.S. PATENT DOCUMENTS 3,110,476 A * 11/1963 Farris ..... B66F 7/065 254/122
3,553,743 A * 1/1971 Lodige ..... B08B 3/04 4/495
3,935,600 A * 2/1976 Scribner ..... E04H 4/065 4/495
4,405,116 A * 9/1983 Eisenberg ..... B66F 7/0608 182/141
4,754,713 A * 7/1988 Chatenay epouse Compagnone ..... A63J 1/00 100/144
6,105,180 A * 8/2000 Kramer ..... E04H 4/065 254/92
2009/0235446 A1 9/2009 Juracek

FOREIGN PATENT DOCUMENTS

DE 1759574 A1 * 10/1971 ..... E04H 4/065
DE 2258127 A1 5/1974
DE 2261404 C2 7/1983
FR 2187600 A1 1/1974
FR 2776322 A1 9/1999
FR 2910036 A1 6/2008

OTHER PUBLICATIONS

DE 2244588 machine translation. Espacenet. (Year: 2020).*

* cited by examiner

*Primary Examiner* — Erin Deery
(74) *Attorney, Agent, or Firm* — Guy Levi; The IP Law Firm of Guy Levi, LLC

(57) ABSTRACT

A system for adjusting surface level, including a moveable surface, at least two structures adapted to be disposed between and coupled to the moveable surface and a fixed surface, a single force transfer mechanism configured to be coupled to the at least one of the at least two structures for displacement of the moveable surface relative to the fixed surface.

17 Claims, 4 Drawing Sheets

SYSTEM FOR ADJUSTING SURFACE LEVEL

REFERENCE TO RELATED APPLICATIONS

Reference is made to PCT Patent Application No. PCT/IB2011/055445, filed Dec. 5, 2011 and entitled "SYSTEM FOR ADJUSTING SURFACE LEVEL", the disclosure of which is hereby incorporated by reference.

Reference is additionally made to U.S. provisional Patent Application Ser. No. 61/717,646, filed Oct. 24, 2012 and entitled "SYSTEM FOR ADJUSTING SURFACE LEVEL", the disclosure of which is hereby incorporated by reference and priority of which is hereby claimed pursuant to 37 CFR 1.78(a) (4) and (5)(i).

FIELD OF THE INVENTION

The present invention relates to systems for adjusting surface level and more particularly to a mechanical system for adjusting floor level.

BACKGROUND OF THE INVENTION

Swimming pools create permanent danger for people, animals and objects around them, especially for babies, kids, people and animals that cannot swim. Hence movable floors came to exist, so the swimming pool has one permanent base floor, and above it a movable floor which may be raised so as to provide a solid cover for the swimming pool and adjust the swimming pool depth as desired by any given user: shallow for babies and kids, deep for adult users.

The following publications are believed to represent the current state of the art:

U.S. Pat. Nos. 3,045,253; 3,413,661; 3,553,743; 3,564,622; 3,955,797; 4,271,542; 5,678,253; 6,253,390; 6,640,504.

U.S. Publication Nos. 20020062602; 20070220667; 20090165200.

International Publication Nos. JP2005273358; EP0532079; EP1160397; DE2258127; DE2261404; FR2187600; FR2776322; FR2910036.

SUMMARY OF THE INVENTION

The present invention seeks to provide an improved system for adjusting surface level.

There is thus provided in accordance with an embodiment of the present invention a system for adjusting surface level including a moveable surface, at least two structures adapted to be disposed between and coupled to the moveable surface and a fixed surface, a single force transfer mechanism configured to be coupled to the at least one of the at least two structures for displacement of the moveable surface relative to the fixed surface. Preferably, at least two structures are adapted for slidable movement relative to the movable surface.

In accordance with an embodiment of the present invention, the at least two structures consist of a first structure having at least one solid rod being disposed between and adapted to be coupled to the fixed surface and to the moveable surface and a second structure having at least one solid rod being disposed between and adapted to be coupled to the fixed surface and to the moveable surface, wherein the first structure is spaced apart from the second structure. Preferably, the at least one solid rod of the first structure has a sliding element on a first end for slidable engagement with the movable surface and a hinge on a second end for hinged engagement with the fixed surface and the at least one solid rod of the second structure has a sliding element on a first end for slidable engagement with the movable surface and a hinge on a second end for hinged engagement with the fixed surface.

Further, in accordance with an embodiment of the present invention, a connecting rod is disposed between the first structure and the second structure, wherein the connecting rod is moveably coupled to the first structure at a first end and hingedly coupled to the second structure at a second end.

Preferably, the first structure has at least two elongated rods that are parallel one to another and a truss fixedly connected to each of the rods and connecting therebetween and the second structure has at least two elongated rods that are parallel one to another and a truss fixedly connected to each of the rods and connecting therebetween.

In accordance with an embodiment of the present invention, the force transfer mechanism is a hydraulic cylinder, which is hingedly coupled with the truss of the at least one of the first and second structures.

Preferably, the moveable surface is adapted to fit an interior perimeter of a swimming pool. Further preferably, force transfer mechanism is disposed within the swimming pool. Alternatively, the force transfer mechanism is disposed outside of the swimming pool.

Yet further in accordance with an embodiment of the present invention, the single force transfer mechanism is employed in order to displace both the first structure and the second structure using the connecting rod, which provides for force transfer from the second structure to the first structure.

Preferably, an L-shaped aperture is formed in the second end of the connecting rod, the L-shaped aperture has a first portion which is disposed generally transversely to a longitudinal axis of the connecting rod and a second portion which is disposed generally in parallel to the longitudinal axis of the connecting rod.

Further preferably, a hinge protrudes transversely outwardly from the at least one elongated rod of the first structure so as to fit within one of the first and second portions of the L-shaped aperture.

Still further preferably, in a first orientation of the hinge when the hinge is positioned in the first portion of the L-shaped aperture, the first structure and the second structure are operative for moving in parallel relative to each other enabling axial vertical displacement of the movable surface, and in a second orientation of the hinge when the hinge is positioned in the second portion of the L-shaped aperture, the second structure is operative for radial movement relative the first structure, thereby enabling radial displacement of the movable surface relative the fixed surface.

In accordance with an embodiment of the present invention, a stopper is disposed on the fixed surface. Preferably, transition between the first and second orientations of the hinge results from restraining radial displacement of the first structure against the stopper. Further preferably, the stopper extends partially along a length of the elongated rod and is generally parallel thereto. Yet further preferably, the stopper has an inclined engagement surface, which is operative to engage the truss of the first structure following radial displacement of the first structure.

Further in accordance with an embodiment of the present invention a method for adjusting surface level, including the following steps: providing a moveable surface; providing at least two structures disposed between the moveable surface and a fixed surface; coupling a single force transfer mechanism to at least one of the at least two structures; actuating the force transfer mechanism for providing slidable movement of the at least one of the at least two structure relative the moveable surface, thereby producing radial displacement of at least one of the at least two structures.

Still further in accordance with an embodiment of the present invention a method for adjusting surface level, including the following steps: providing a moveable surface; providing at least two structures disposed between the moveable surface and a fixed surface; coupling a single force transfer mechanism to at least one of the at least two structures; actuating the force transfer mechanism for sequentially providing for axial displacement of the moveable surface and for radial displacement of the moveable surface.

BRIEF DESCRIPTION OF THE DRAWINGS

The present invention will be understood and appreciated more fully from the following detailed description, taken in conjunction with the drawings in which.

DETAILED DESCRIPTION OF PREFERRED EMBODIMENTS

Mechanical systems for adjustment of a surface level are described. The surface may be the floor of a swimming pool, the cover of a swimming pool, or it may alternatively be any surface that can be vertically adjustable, such as for example a wall or a window.

According to one specific embodiment of the present invention the system for adjusting a surface level may be employed for changing the depth of a swimming pool floor, and for inclining the floor whenever desired.

In accordance to an embodiment of the present invention, the system includes means for axial and radial movement of a movable structure in a manner that provides a strong, stable and safe floor at any desired depth. The described system, in accordance to the embodiments of the present invention, is simple and inexpensive to construct and provides a stable floor with the ability to carry heavy loads, similar to regular or heavy constructed floors.

Figure 1:
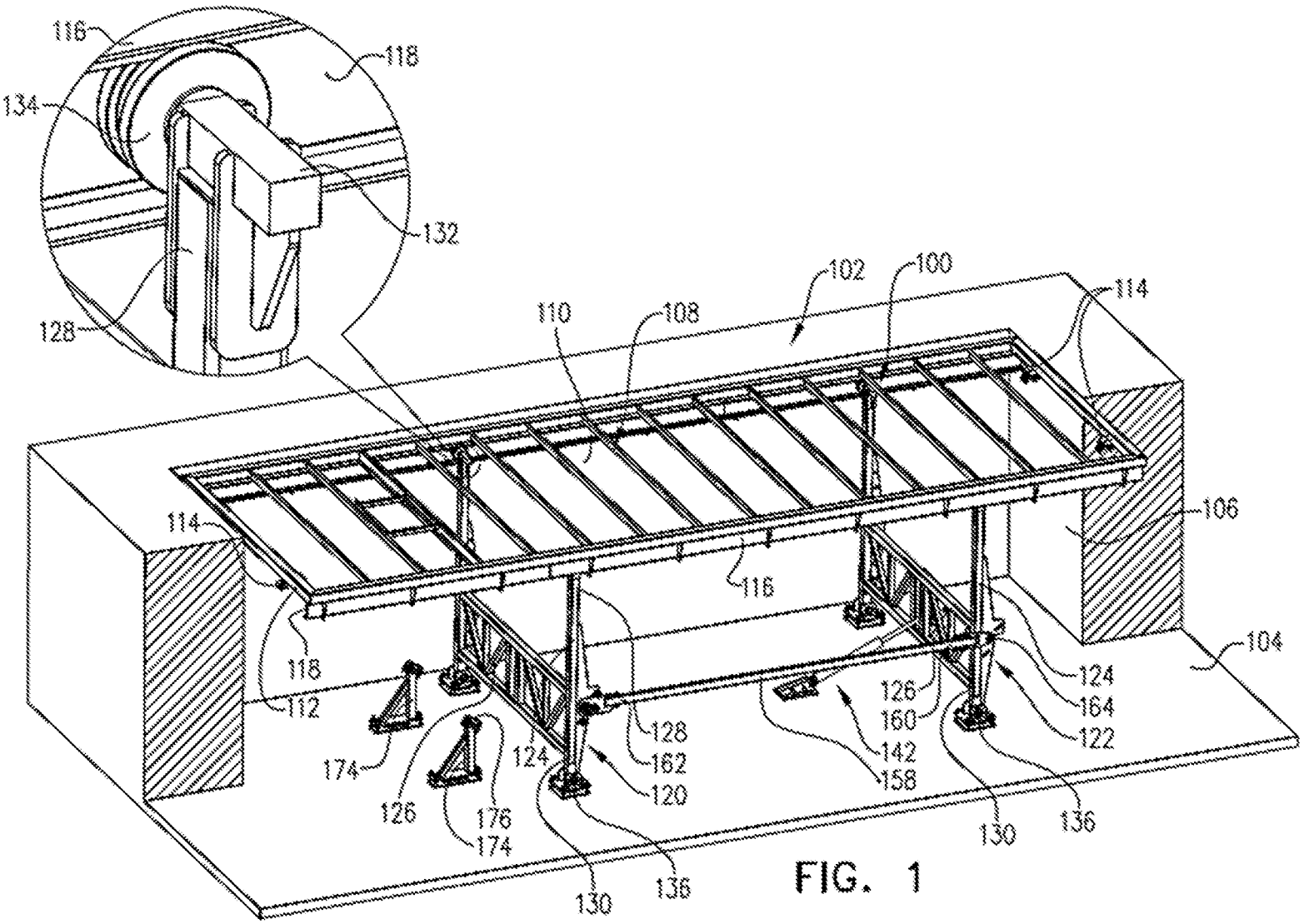
FIG. 1 is a simplified pictorial illustration of a system for adjusting surface level in a raised position within a partial section view of a pool and an enlargement view, constructed and operative in accordance with an embodiment of the present invention.
Figure 2:
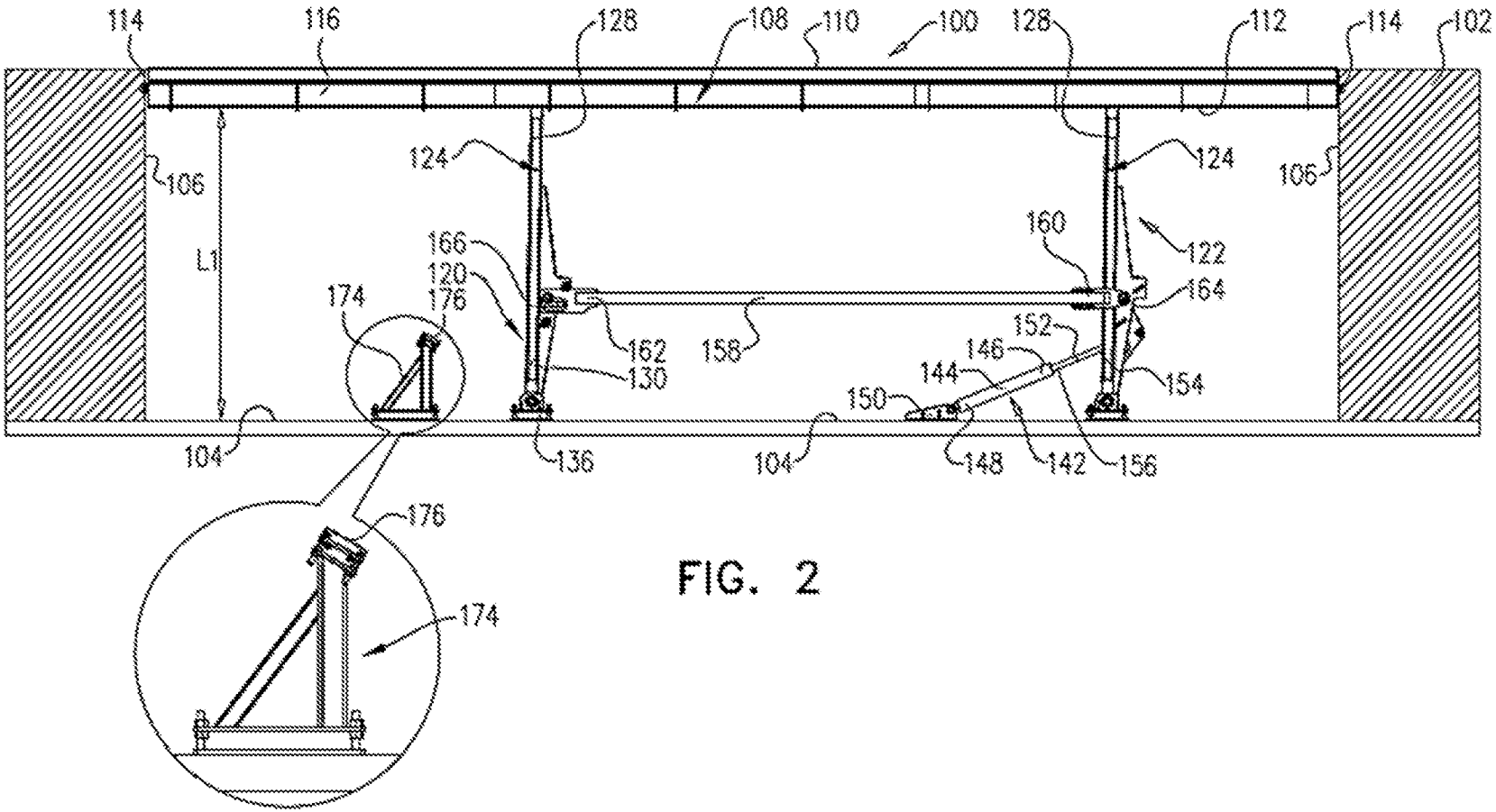
FIG. 2 is a simplified side view of the system for adjusting surface level of FIG. 1, within a dashed view of a pool and an enlargement view.

Reference is now made to FIG. 1, which is a simplified pictorial illustration of a system for adjusting surface level in a raised position within a partial section view of a pool and an enlargement view, constructed and operative in accordance with an embodiment of the present invention and to FIG. 2, which is a simplified side view of the system for adjusting surface level of FIG. 1, within a dashed view of a pool and an enlargement view.

It is seen in FIGS. 1 & 2 that a system 100 for adjusting surface level is shown in a partially sectional view of a swimming pool 102.

The swimming pool 102 preferably has a bottom fixed surface 104 and side walls 106 transversely extending therefrom.

A moveable surface 108 is disposed within the swimming pool 102 above the system 100 and preferably has a shape that fits the inner perimeter formed by the side walls 106 of the swimming pool 102. The movable surface 108 has two opposite surfaces, an upper surface 110 and an opposite lower surface 112 facing the fixed surface 104.

It is seen that at least one suitable sliding element 114 may be attached to the opposite ends of the moveable surface 108, which is adapted to protect the side walls 106 of the swimming pool 102 during the displacement of moveable surface 108.

There is a longitudinal rail 116 preferably extending downwardly from each of the two remaining opposite sides of the moveable surface 108. The longitudinal rails 116 are preferably C-shaped, having their open sides facing each other and forming a longitudinal path 118 within each rail 116.

The system 100 includes a first structure 120 and a second structure 122, which are disposed generally in parallel one to another, as seen in FIGS. 1 & 2 and are preferably spaced apart.

The first and second structures 120 and 122 are preferably disposed between the fixed surface 104 and the movable surface 108. The first structure 120 and the second structure 122 are preferably similar in all respects, thus one of the structures will be further described and similar reference numerals will be designated for similar parts of the two structures 120 and 122.

The first structure 120 preferably has a frame, which includes two generally elongated solid rods 124 that are parallel one to another and a truss 126 fixedly connected to each of these rods 124 and connecting therebetween. The solid rod 124 preferably has two opposite ends 128 and 130. An axis 132 having a bearing 134 on its end is coupled to the end 128 of the rod 124 and arranged transversely to the rod 124. The rod 124 is movably coupled to the movable surface 108 due to the sliding of the bearing 134 within the path 118 of the rail 116 or alternatively due to direct engagement between the bearing 134 and the movable surface 108. It is noted that any suitable mechanism may be employed in order to achieve movable coupling between the end 128 of the rod 124 and between the movable surface 108.

Figure 3:
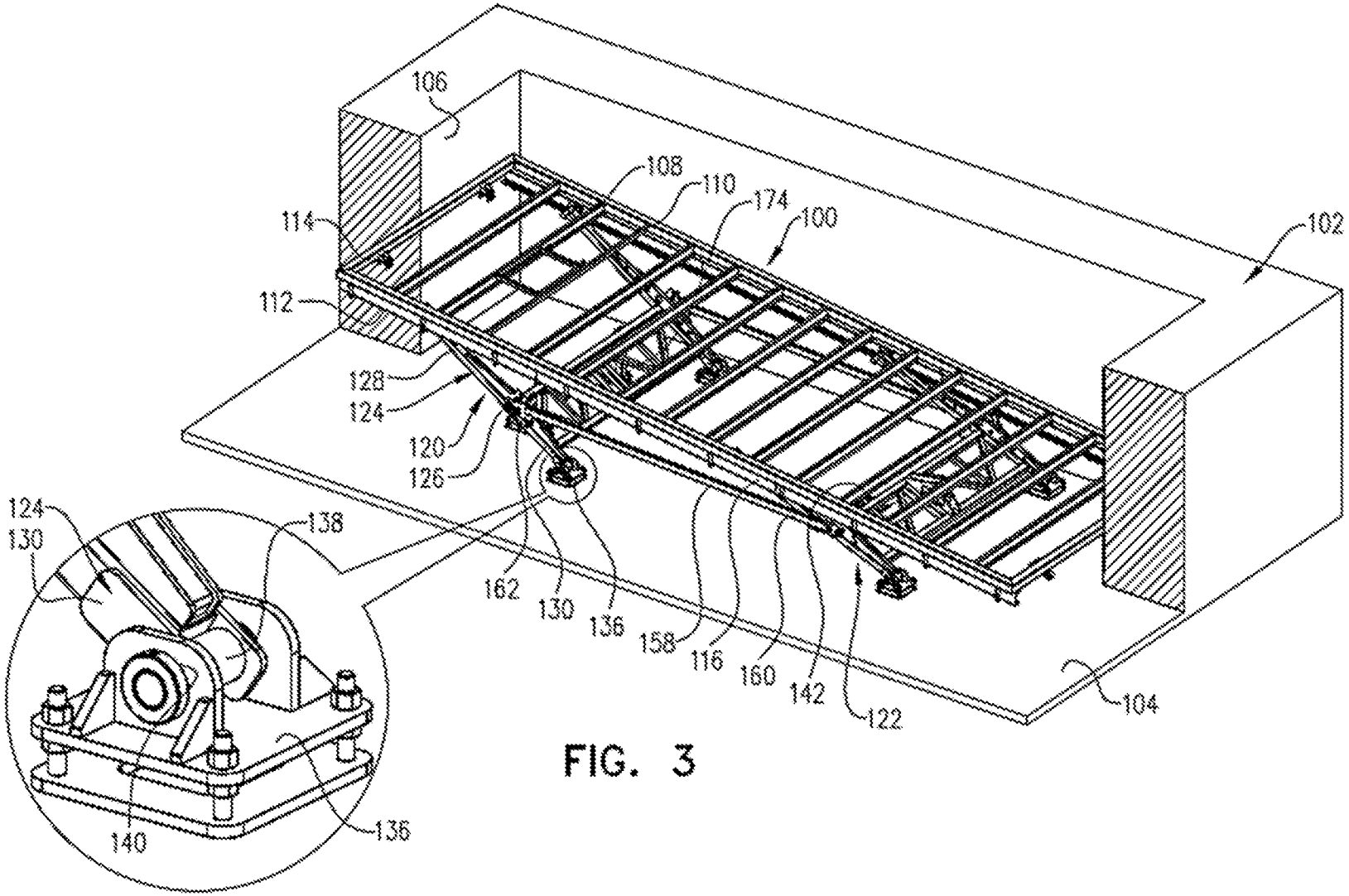
FIG. 3 is a simplified pictorial illustration of the system for adjusting surface level in a lowered position within a partial section view of a pool and an enlargement view, corresponding to FIG. 1.

As seen in the enlargement view of FIG. 3, the ends 130 of the elongated rods 124 are preferably hingedly connected to the fixed surface 104 through at least one connector member 136. The end 130 of the elongated rod 124 preferably has an opening therethrough and an axis 138 extending transversely to the rod 124 and through this opening. The connector 136 preferably has an opening 140 through which the axis 138 extends and operative for rotation within the opening 140 and thus allow rotatable displacement of the elongated rod 124.

It is further seen in FIGS. 1 & 2 that a force transfer mechanism 142 is coupled to the second structure 122. It is appreciated that force transfer mechanism 142 may be alternatively coupled to the first structure 120. The force transfer mechanism 142 in this particular embodiment depicted in FIGS. 1 & 2 is coupled to the truss 126 of the second structure 122.

The force transfer mechanism 142 according to an embodiment of the present invention has a hydraulic cylinder, however it is appreciated that the invention is not limited to this possibility only and any available force transfer device can be interplaced in order to transfer force to the first structure 120 and to the second structure 122, for example, electric plunger, electric transmission motor, hydraulic motor or any other actuator that enables displacement of the first and second structures 120 and 122.

The force transfer mechanism 142 typically has a hydraulic cylinder 144 having a first end 146 and a second end 148, wherein the second end 148 is adapted to be hingedly coupled with the fixed surface 104 by means of a supporting member 150. The hydraulic cylinder 144 is preferably slidably associated with a plunger rod 152, having a first end 154 and a second end 156. The second end 156 of the plunger rod 152 is slidably inserted into the first end 146 of the hydraulic cylinder 144 and the first end 154 of the plunger rod 152 is hingedly connected to the truss 126 of the second structure 122.

It is appreciated that the force transfer mechanism 142 may be disposed within the swimming pool 102, as depicted in the embodiment of the present invention shown in FIGS. 1-4 and may be alternatively disposed in a separate compartment outside the swimming pool in order to avoid exposure of the force transfer mechanism to water, prevent corrosion and allow for using oils as well as water as the hydraulic fluid. In case that the force transfer mechanism is disposed in a separate compartment, the coupling between it and between the second structure 122 can be achieved through a rod extending through a wall formed between the compartments.

It is a particular feature of an embodiment of the present invention that a single force transfer mechanism 142 is employed in order to displace both the first structure 120 and the second structure 122. This is achieved due to a connecting rod 158, which connects the first structure 120 and the second structure 122 and provides for force transfer from the second structure 122 to the first structure 120.

Figure 4:
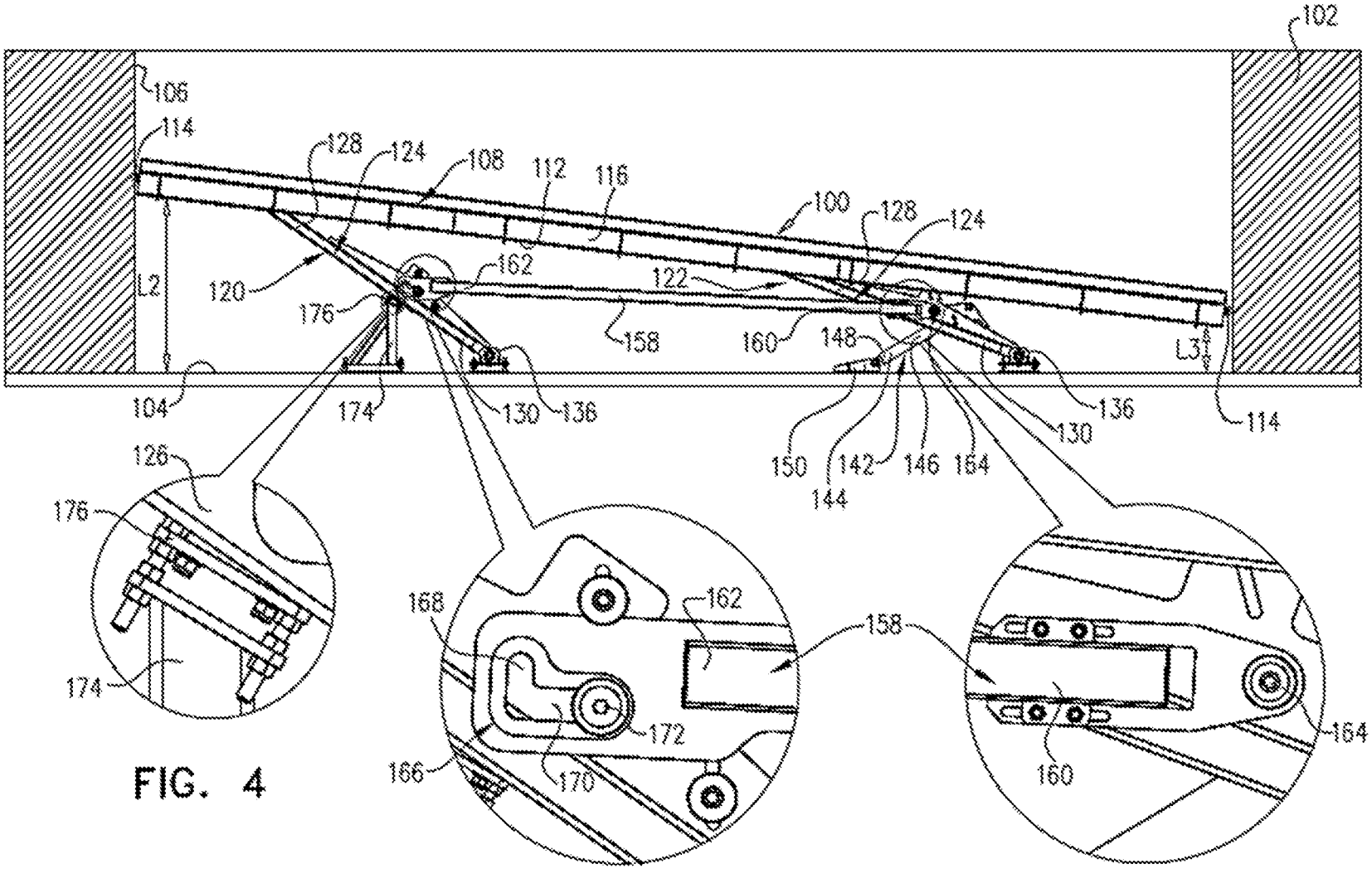
FIG. 4 is a simplified side view of the system for adjusting surface level of FIG. 3, within a dashed view of a pool and corresponding enlargement views.

It is seen in FIGS. 1 & 2 and further particularly seen in the enlargements views of FIG. 4 that the connecting rod 158 has two opposite ends, a first end 160 is preferably hingedly connected to the second structure 122 and the second end 162 is preferably movably connected to the first structure 120.

It is noted that the first end 160 of the connecting rod 158 is attached to preferably one of the elongated rods 124 of the second structure 122 using a hinge 164, thus allowing rotation of the connecting rod 158 relative to the second structure 122.

It is further noted that the second end 162 of the connecting rod 158 preferably has an L-shaped aperture 166 formed therethrough. The L-shaped aperture 166 preferably has a first portion 168 that is disposed generally transversely to the longitudinal axis of the connecting rod 158 and a second portion 170 that is disposed generally in parallel to the longitudinal axis of the connecting rod 158.

One of the longitudinal rods 124 of the first structure 120 has a hinge 172 protruding transversely outwardly therefrom so as to fit within one of the portions 168 and 170 of the L-shaped aperture 166. The diameter of the hinge 172 is such that it fits precisely within one of the portions 168 and 170 of the L-shaped aperture 166.

It is a particular feature of an embodiment of the present invention that in a first orientation of the hinge 172 within the L-shaped aperture 166, the first structure 120 and the second structure 122 are moving in parallel relative to each other enabling axial vertical displacement of the movable surface 108, while in a second orientation of the hinge 172 within the L-shaped aperture 166, the second structure 122 is radially movable relative to the first structure 120, thereby enabling radial displacement of the movable surface 108 relative to the fixed surface 104.

A particular embodiment of the above mentioned first and second orientations of the hinge 172 is seen in FIGS. 1-4, where as long as the hinge 172 is disposed within the first portion 168 of the L-shaped aperture 166 of the connecting rod 158, the first structure 120 and the second structure 122 move in parallel to each other and the movable surface 108 is vertically raised or lowered, in parallel to the fixed surface 104. Once the hinge 172 is disposed within the second portion 170 of the L-shaped aperture 166 of the connecting rod 158, the second structure 122 moves radially relative to the first structure 120 and the movable surface 108 is thus displaced radially and assumes an inclined orientation relative to the fixed surface 104.

It is a further particular feature of an embodiment of the present invention that the transition between first and second orientations of the hinge 172 are affected by restraining the radial displacement of the first structure 120, which is coupled to the end 162 of the connecting rod 158.

It is appreciated that any alternative mechanism that restrains relative radial movement between the first structure 120 and the second structure 122 at one period of time and allows such relative radial movement at another period of time may be suitable and thus is considered to be within the scope of the present invention. An example for such alternative mechanism may be a hinge having an obround or elliptical cross-section and movable through a longitudinal aperture within a rod.

It is further seen in FIGS. 1 & 2 and in the enlargement view of FIG. 2 that at least one stopper 174 is preferably disposed spaced apart from the first structure 120 and is fixedly connected to the fixed surface 104. The stopper 174 extends partially along the length of the longitudinal rod 124 and is generally parallel thereto. The stopper 174 preferably has an inclined engagement surface 176, which is operative to engage the truss 126 of the first structure 120 following radial displacement of the first structure 120, as will be described in detail hereinbelow. This stopper 174 is operative for restraining the radial displacement of the first structure 120, as noted hereinabove.

In accordance with an embodiment of the present invention, when the plunger rod 152 extends from the first end 146 of the hydraulic cylinders 144, thus positioning the first end 154 of the plunger rod 152 away from the first end 146 of the hydraulic cylinders 144, the force transfer mechanism 142 assumes an extended position. When the first end 154 of the plunger rod 152 is positioned adjacent the first end 146 of the hydraulic cylinder 144, the force transfer mechanism 142 assumes a retracted position.

It is seen that the system 100 in FIGS. 1 & 2 is shown while the force transfer device 142 is in the extended position and the first and second structures 120 and 122 are generally positioned in parallel one to another. The movable surface 108 is disposed at a distance L1 from the fixed surface 104, assuming a raised position of the system 100. In the raised position, the moveable surface 108 is adapted to be substantially in line with the upper surface of the swimming pool 102, securely covering the swimming pool 102. In this raised position of the system 100, the elongated rods 124 of the first structure 120 and of the second structure 122 are locked in place due to the force of the force transfer mechanism 142 exerted on the truss 126 of the second structure 122.

It is appreciated that first and second structures 120 and 122 are preferably not positioned perpendicularly relative the movable surface 108, rather they are slightly inclined, thus providing reliable locking of the movable surface 108 by the force transfer mechanism 142.

The solid rods 124, truss 126 and connecting rod 158 are preferably made of durable materials that provide a rigid structural moveable surface 108, which acts as the cover of the swimming pool 102.

It is a particular feature of an embodiment of the present invention that upon initial actuation of the force transfer mechanism 142, the connecting rod 158 is given under tensile stress, thus acting as a link between the first structure 120 and the second structure 122. This provides for higher reliability, prevents a possibility of connecting rod 158 to collapse and allows decreasing the cross-sectional area of the connecting rod 158.

Reference is now made to FIG. 3, which is a simplified pictorial illustration of the system for adjusting surface level 100 in a lowered position within a partial section view of the pool 102 and an enlargement view, corresponding to FIG. 1 and to FIG. 4, which is a simplified side view of the system for adjusting surface level 100 of FIG. 3, within a dashed view of the pool 102 and corresponding enlargement views.

It is seen that the system 100 in FIGS. 3 & 4 is shown while the force transfer mechanism 142 is in the retracted position. In accordance with an embodiment of the present invention, in the retracted position the moveable surface 108 is inclined relative its raised position and one of its ends is disposed at a distance L2 from the fixed surface 104, where L2 is smaller than L1, and another of its ends is disposed at a distance L3 from the fixed surface 104, where L3 is smaller than L2 thus assuming a lowered position of the system 100. In the lowered position, the moveable surface 108 is adapted to be lower than the upper surface of the swimming pool 102, acting as the floor of the swimming pool 102.

It is a particular feature of an embodiment of the present invention that activation of a single force transfer mechanism 142 allows gradual combined displacement of the moveable surface 108, which is first lowered in parallel to the fixed surface 104, assuming an intermediate position of the system 100 and then lowered radially in an inclined manner into the lowered position of the system 100.

In the particular embodiment of the present invention depicted in FIGS. 1-4, the stopping structure that allows this gradual combined movement of the moveable surface 108 is described hereinbelow.

Hydraulic pressure is applied on the hydraulic cylinder 144 and the first end 154 of the plunger rod 152 is moved toward the first end 146 of the hydraulic cylinder 144. Following this retraction of the plunger rod 152, the first structure 120 and the second structure 122 are pivoting about axis 138 due to the sliding of the bearing 134 within the longitudinal path 118 of the moveable surface 108 and due to the hinged connection of the elongated rods 124 to the fixed surface 104. The first structure 120 is connected with the second structure 122 by means of the connecting rod 158. The retraction of the plunger rod 152 and the hinged connection of the first end 160 of the connection rod 158 with the second structure 122 allow for corresponding movement of the first structure 120 along with and in parallel to the second structure 122.

It is appreciated that any alternative means for transferring force between the second structure 122 and the first structure 120 may be suitable and should be considered within the scope of the present invention.

At this stage, the hinge 172 is positioned and held within the first portion 168 of the L-shaped aperture 166 of the connecting rod 158, thus forcing the first structure 120 to pivot in parallel to the second structure 122 and thus axially displacing the moveable surface 108 in parallel to the fixed surface 104 until assuming the intermediate position of the system 100.

This axial displacement of the moveable surface 108 continues until the inclined surface 176 of the stopper 174 engages the truss 126, thus assuming the intermediate position of the system 100. Once the inclined surface 176 of the stopper 174 engages the truss 126, it forces the hinge 172 out of the first portion 168 of the L-shaped aperture 166 of the connecting rod 158 into the second portion 170, where it can slidably move.

Following further retraction of the plunger rod 152, the first structure 120 remains restrained from displacement against the inclined surface 176 of the stopper 174 and further pivoting of the second structure 122 about axis 138 is allowed due to the sliding movement of the hinge 172 along the second portion 170 of the L-shaped aperture 166 of the connecting rod 158. The pivoting of the second structure 124 provides for radial displacement of the moveable surface 108 until it assumes the lowered position of the system 100, where one end of the moveable surface is disposed at a distance L2 from the fixed surface 104 and the other end of the moveable surface 108 is disposed at a distance L3 from the fixed surface 104, where L3 is smaller than L2.

It is appreciated that the system 100 may be designed without the stopper 174, in which case the first structure 120 and the second structure 122 will move in parallel to each other, since the hinge 172 will not be forced into the second portion 170 of the L-shaped aperture 166 and the moveable surface 108 will then be axially displaced in parallel to the fixed surface 104. Alternatively, the height of the stopper 174 may be changed in order to provide for a different depth for beginning of the inclined movement of the moveable surface 108.

It is noted that the system 100 can be raised in a similar graduate manner, wherein while extending the plunger rod 152, the hinge 172 firstly slidably moves through the second portion 168 of the L-shaped aperture 166 of the connecting rod 158, thus allowing raising the moveable surface 108 in an inclined manner. Once the truss 126 of the first structure 120 disengages the inclined surface 176 of the stopper 174, the hinge 172 is moved into the first portion 168 of the L-shaped aperture 166 of the connecting rod 158, thus only allowing the first structure 120 to pivot in parallel to the second structure, thereby axially displace the moveable surface 108 in parallel to the fixed surface 104, until it is disposed at a distance L1 therefrom.

It will be appreciated by persons skilled in the art that the present invention is not limited by what has been particularly shown and described hereinabove. Rather the scope of the present invention includes both combinations and subcombinations of various features described hereinabove as well as variations and modifications thereof which are not in the prior art.

The invention claimed is:

1. A system for adjusting surface level, comprising:

a moveable surface;

at least two structures adapted to be disposed between and coupled to said moveable surface and a fixed surface, said at least two structures being radially displaceable in the same direction;

a single force transfer mechanism configured to be coupled to at least one of said at least two structures for displacement of said moveable surface relative to said fixed surface, and wherein said single force transfer mechanism is operative for enabling parallel displacement of said movable surface with respect to said fixed surface, whereas said at least two structures being displaceable in parallel to each other in a first mode of operation, and wherein said single force transfer mechanism is further operative for enabling radial displacement of said movable surface with respect to said fixed surface, whereas said at least two structures being relatively displaceable radially with respect to each other in a second mode of operation, and wherein said at least two structures comprise a first structure having at least one solid rod being disposed between and adapted to be coupled to said fixed surface and to said moveable surface and a second structure having at least one solid rod being disposed between and adapted to be coupled to said fixed surface and to said moveable surface, wherein said first structure is spaced apart from said second structure, and a connecting rod disposed between said first structure and said second structure, wherein said connecting rod is moveably coupled to said first structure at a first end and hingedly coupled to said second structure at a second end.

2. The system for adjusting surface level according to claim 1, and wherein said at least two structures are adapted for slidable movement relative to said movable surface.

3. The system for adjusting surface level according to claim 1, and wherein said at least one solid rod of said first structure has a sliding element on a first end for slidable engagement with said movable surface and a hinge on a second end for hinged engagement with said fixed surface and said at least one solid rod of said second structure has a sliding element on a first end for slidable engagement with said movable surface and a hinge on a second end for hinged engagement with said fixed surface.

4. The system for adjusting surface level according to claim 1, and wherein said at least one solid rod of said first structure comprises two elongated rods that are parallel one to another and a truss fixedly connected to each of said two elongated rods and connecting therebetween and said at least one solid rod of said second structure comprises two elongated rods that are parallel one to another and a truss fixedly connected to each of said two elongated rods and connecting therebetween.

5. The system for adjusting surface level according to claim 4, and wherein said force transfer mechanism is a hydraulic cylinder, which is hingedly coupled with the truss of said at least one of said first and second structures.

6. The system for adjusting surface level according to claim 1, and wherein said moveable surface is adapted to fit an interior perimeter of a swimming pool.

7. The system for adjusting surface level according to claim 1, and wherein said force transfer mechanism is configured to be disposed outside of a swimming pool.

8. The system for adjusting surface level according to claim 1, and wherein said single force transfer mechanism is employed in order to displace both said first structure and said second structure using said connecting rod, which provides for force transfer from said second structure to said first structure.

9. The system for adjusting surface level according to claim 1, and wherein an L-shaped aperture is formed in said first end of said connecting rod, said L-shaped aperture has a first portion which is disposed transversely to a longitudinal axis of said connecting rod and a second portion which is disposed in parallel to the longitudinal axis of said connecting rod.

10. The system for adjusting surface level according to claim 9, and wherein a hinge protrudes transversely outwardly from said at least one elongated rod of said first structure so as to fit within one of said first and second portions of said L-shaped aperture.

11. The system for adjusting surface level according to claim 9, and wherein in a first orientation of said hinge when said hinge is positioned in said first portion of said L-shaped aperture, said first structure and said second structure are operative for moving in parallel relative to each other enabling axial vertical displacement of said movable surface, and in a second orientation of said hinge when said hinge is positioned in said second portion of said L-shaped aperture, said second structure is operative for radial movement relative said first structure, thereby enabling radial displacement of said movable surface relative said fixed surface.

12. The system for adjusting surface level according to claim 11, and further comprising a stopper disposed on said fixed surface, and wherein said stopper extends partially along a length of said elongated rod and is parallel thereto.

13. The system for adjusting surface level according to claim 11, and further comprising a stopper disposed on said fixed surface, and wherein said stopper has an inclined engagement surface, which is operative to engage the truss of the first structure following radial displacement of said first structure.

14. The system for adjusting surface level according to claim 1, and wherein said force transfer mechanism is configured to be disposed within a swimming pool.

15. A method for adjusting surface level, comprising:

providing the system of claim 1;

actuating said force transfer mechanism for providing slidable movement of said at least one of said at least two structures relative said moveable surface, thereby producing radial displacement of at least one of said at least two structures;

and adjusting surface level of said moveable surface relative to said fixed surface.

16. The method for adjusting surface level according to claim 15, and wherein actuation of said force transfer mechanism displaces said moveable surface in parallel to said fixed surface when said at least two of structures are displaced in parallel with respect to each other and actuation of said force transfer mechanism inclines said moveable surface with respect to said fixed surface when said at least two structures are relatively displaced radially with respect to each other.

17. A method for adjusting surface level, comprising:

providing the system of claim 1;

actuating said force transfer mechanism for either displacing said moveable surface in parallel to said fixed surface or for inclining said movable surface with respect to said fixed surface; and adjusting surface level of said moveable surface relative to said fixed surface.

* * * * *